US006487843B1

(12) United States Patent
Tomczyk

(10) Patent No.: US 6,487,843 B1
(45) Date of Patent: Dec. 3, 2002

(54) TURBOMACHINE AND METHOD FOR OPERATING

(75) Inventor: Hubert Tomczyk, Düsseldorf (DE)

(73) Assignee: DIRO Konstruktions GmbH & Co, KG, Rühen-Brechtorf (DE)

( * ) Notice: Subject to any disclaimer, the term of this patent is extended or adjusted under 35 U.S.C. 154(b) by 0 days.

(21) Appl. No.: 10/020,351

(22) Filed: Dec. 12, 2001

Related U.S. Application Data

(63) Continuation of application No. PCT/DE00/01857, filed on Jun. 9, 2000.

(51) Int. Cl.[7] ..... F02C 3/02
(52) U.S. Cl. ..... 60/39.45
(58) Field of Search ..... 60/39.45, 727

(56) References Cited

U.S. PATENT DOCUMENTS

| | | | | |
|---|---|---|---|---|
| 3,310,043 A | * | 3/1967 | Gamage | 123/204 |
| 3,693,601 A | | 9/1972 | Sauder | |
| 3,995,431 A | | 12/1976 | Schwartzman | |
| 4,170,107 A | * | 10/1979 | Horler | 123/563 |
| 5,197,276 A | * | 3/1993 | Keller | 60/39.45 |

FOREIGN PATENT DOCUMENTS

| | | |
|---|---|---|
| CH | 464 606 | 12/1968 |
| DE | 25 00 816 | 7/1976 |
| DE | 276 512 | 2/1990 |
| DE | 94 01 804 | 4/1994 |
| DE | 44 26 265 | 2/1996 |
| EP | 0 037 218 | 10/1981 |

* cited by examiner

*Primary Examiner*—Ehud Gartenberg
(74) *Attorney, Agent, or Firm*—Husch & Eppenberger, LLC; Robert E. Muir; Richard J. Musgrave

(57) ABSTRACT

A turbomachine is operated in a manner to improve the degree of efficiency of a machine of this type. To this end, fresh air that has been drawn in by suction is isochorically heated in individual, closed off conveying and heating chambers, which are arranged in succession in the conveying direction, and then supplied to a working machine in which the air is expanded and behind which the air is burned after being mixed with fuel. The resulting combustion gases are then guided past the conveying and heating chambers in the opposite direction to the conveying direction of the same, in such a way that the fresh air that is drawn in by suction is successively isochorically heated in said chambers.

8 Claims, 5 Drawing Sheets

TURBOMACHINE AND METHOD FOR OPERATING

APPLICATION CROSS REFERENCE

This application is a continuation of PCT Application No. PCT/DE00/01 857 filed Jun. 9, 2000 and which named the United States as a designated country. PCT APPLICATION PCT/DE00/01857 was published on Dec. 21, 2000 as Publication No. WO 00/77363 and claims priority of German Application 199 26 891.6 filed on Jun. 12, 1999.

FIELD OF THE INVENTION

The invention relates generally to the field of turbomachinery and, more specifically to an improved turbomachine and to a method for operating a turbomachine.

DESCRIPTION OF THE RELATED ART

In conventional engines, approximately one third of the total heat energy of the fuel is lost in the cooling water and one third is lost in the exhaust gases. In the case of an uncooled engine, the energy yield can only be slightly increased from, for example, 34% to a maximum of 38.5%, but only by accepting an increase in the exhaust gas loss.

It is known in the art to provide, for example, turbochargers for the partial recovery of exhaust gas energy. By means of turbochargers, however, only the volumetric efficiency can, in the end, be increased in the case of piston engines, but the exhaust gas energy cannot be completely utilized.

CH 464 606 shows a method for cooling a screw-type engine, in which fresh air is heated between a compressor and a combustion chamber by means of exhaust gases in the counterflow method. In this case, the compressor is necessary for generating a pressure in order to deliver the fresh air through a eat exchanger.

DE 94 01 804 U1 and DD 276 512 A1 show internal combustion engines with two parallel screw spindles, which mesh with one another and by means of which fresh air is conveyed to a combustion chamber and combustion gases are subsequently supplied to an expansion stage.

SUMMARY OF THE INVENTION

An object of the invention is, therefore, to develop a method and a turbomachine for carrying out the method, by which the heat loss can be reduced.

With respect to the method, this object is achieved, according to the invention, by fresh air being induced as the working medium, then isochorically heated while being continuously conveyed in a delivery direction in individually enclosed delivery and heating chambers which follow one another in the delivery direction. The isochorically heated air is then introduced into a working machine, in which the excess air pressure generated by the isochoric heating is substantially removed by power output. The air is mixed with fuel before its introduction into the working machine and/or the air emerging from the working machine is mixed with fuel and combustion is initiated, the combustion gases are further heated by the combustion being guided in counterflow, i.e. against the delivery direction of the conveying and heating chambers, past the latter in such a way that the induced fresh air is successively and isochorically heated during its continual conveyance in the delivery direction in the conveying and heating chambers.

The object mentioned above is achieved, with respect to the appliance or turbocharger aspect of the invention, by means of at least two meshed axially parallel screw spindles which can be driven in opposite directions but with the same rotational speed. These screw spindles are each configured as a hollow shaft, which form-together with an externally insulated stator tightly enclosing it on the casing side-substantially enclosed respective air chambers extending over a threaded section. During rotation of the screw spindles the chambers are displaced in the axial delivery direction from an air induction connection to an air inlet region of a working machine torsionally connected to the screw spindles. A combustion chamber is provided before the air inlet of the working machine and/or after the air outlet of the working machine. The combustion chamber has a fuel supply and ignition device. The exhaust gases are respectively introduced via an exhaust pipe into an end of a shaft hollow space opposite the air induction connection, which shaft hollow space is configured relative to the air chambers as a counterflow heat exchanger and opens into an exhaust in the region of the air induction connection.

According to the invention, therefore, a part of the heat energy generated by the combustion is converted back into pressure, which results from the isochoric heating of the working medium enclosed in the air chambers. The air pressure gained in this way then performs work in the working machine which can, for example, operate in an opposite sense to the screw-type compressor and the shaft rotation generated by this can be partially utilized, in a preferred embodiment, for air pre-compression at the beginning of the shaft, for example in a screw-type compressor.

After the expansion in the working machine, the air pressure in the heat exchanger drops to the extent necessary to overcome the flow resistances. On the other hand, the air temperature does not fall so rapidly, in accordance with the thermodynamic laws for polytropic expansion, so that the further heating of the air in the afterburner can start from a temperature level which is already high. It is therefore possible to operate with a temperature difference of, for example, some 50° C.–100° C. in the counterflow heat exchanger.

In the system according to the invention, only slight heat losses occur in the insulation covering the system toward the outside; the exhaust gas losses can also be kept very low. Although the system according to the invention requires heat-resistant materials, these are not so severely loaded as, for example, blades/vanes in jet turbines. The system according to the invention is therefore particularly suitable for efficient electricity generators, automobile engines, marine engines and the like.

With respect to the method, it is expedient for the temperature of the combustion gases to be reduced along the counterflow heat exchanger section to approximately the temperature of the induced fresh air and, by this means, for the efficiency to be further increased.

The power can be further increased somewhat by at least part of the fuel being introduced into the isochorically heated trash air before the working machine and by at least partial combustion having been already initiated before the working machine. It is also possible to provide for water to be induced or injected into at least some of the delivery and heating chambers.

The working machine can be a turbine, which can operate on the same shaft as a compressor connected upstream of each screw spindle. Instead of a compressor connected upstream, or in addition to it, compression of the induced fresh air can then take place by each screw spindle having at least one axial section with a thread pitch which decreases in the conveying direction.

In contrast to CH 464 606, fresh air is, according to an aspect of the invention, conveyed in separate conveying and heating chambers in which heating takes place. Because of this, it is not necessary to use a compressor for generating a pressure drop; however, a compressor can be connected upstream in order to deliver compressed fresh air.

In contrast to DE 94 01 804 U1 and DD 276 512 A1, the shaft hollow space is, according to the invention, used as a counterflow heat exchanger for the air chambers so that the isochoric heating, according to an aspect of the invention, of the individual, substantially enclosed air chambers, which are conveyed in the axial direction to the working machine, is made possible.

Further features of the invention are explained in more detail in association with further advantages of the invention, using an exemplary embodiment.

BRIEF DESCRIPTION OF THE DRAWINGS

As an example, one embodiment of the invention is represented in the drawings which also illustrate one embodiment for carrying out the method. In the drawings.

DETAILED DESCRIPTION

Figure 1:
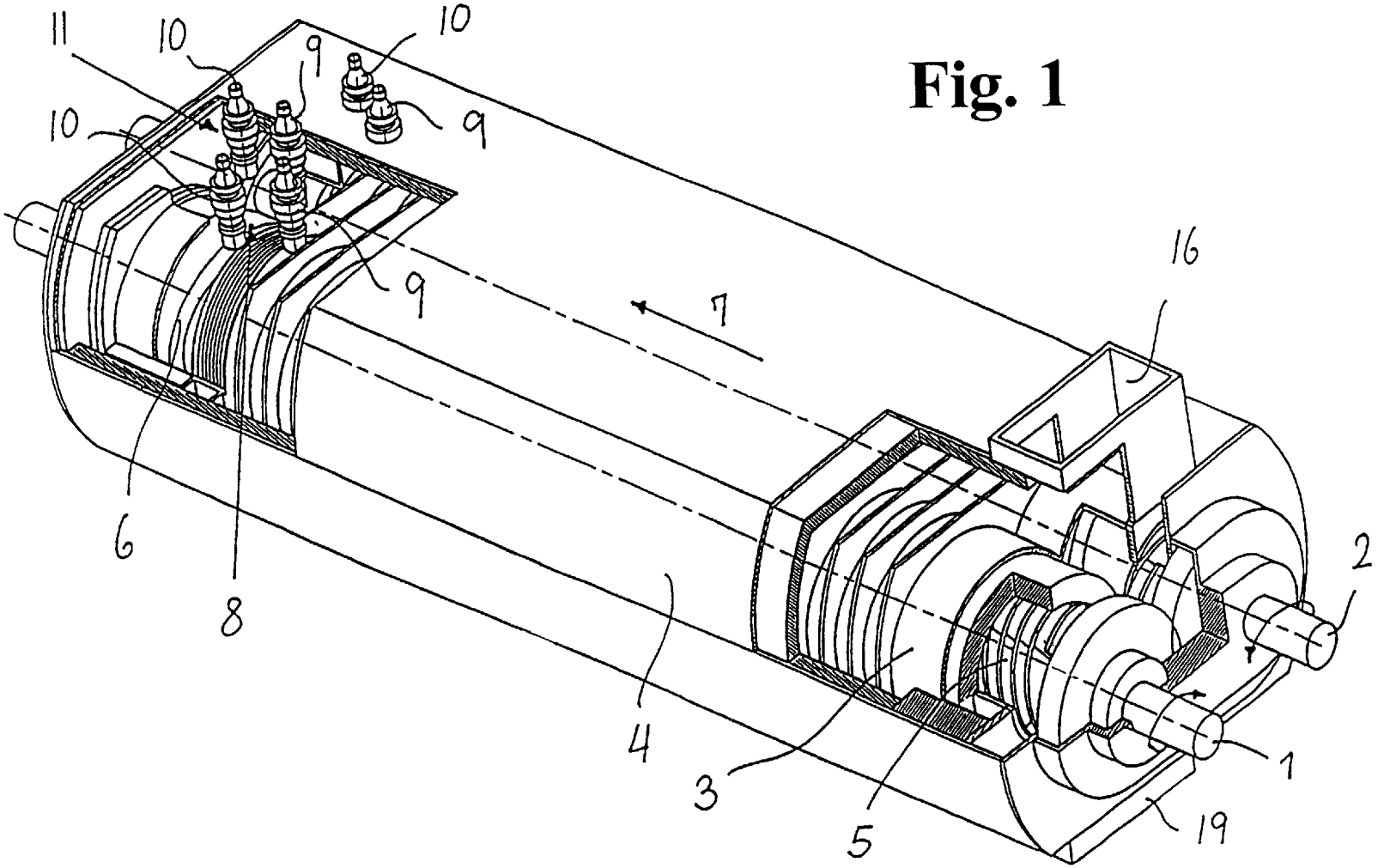
FIG. 1 is a diagrammatic representation of a turbomachine with a stator casing which is partially opened up for ease of viewing.
Figure 5:
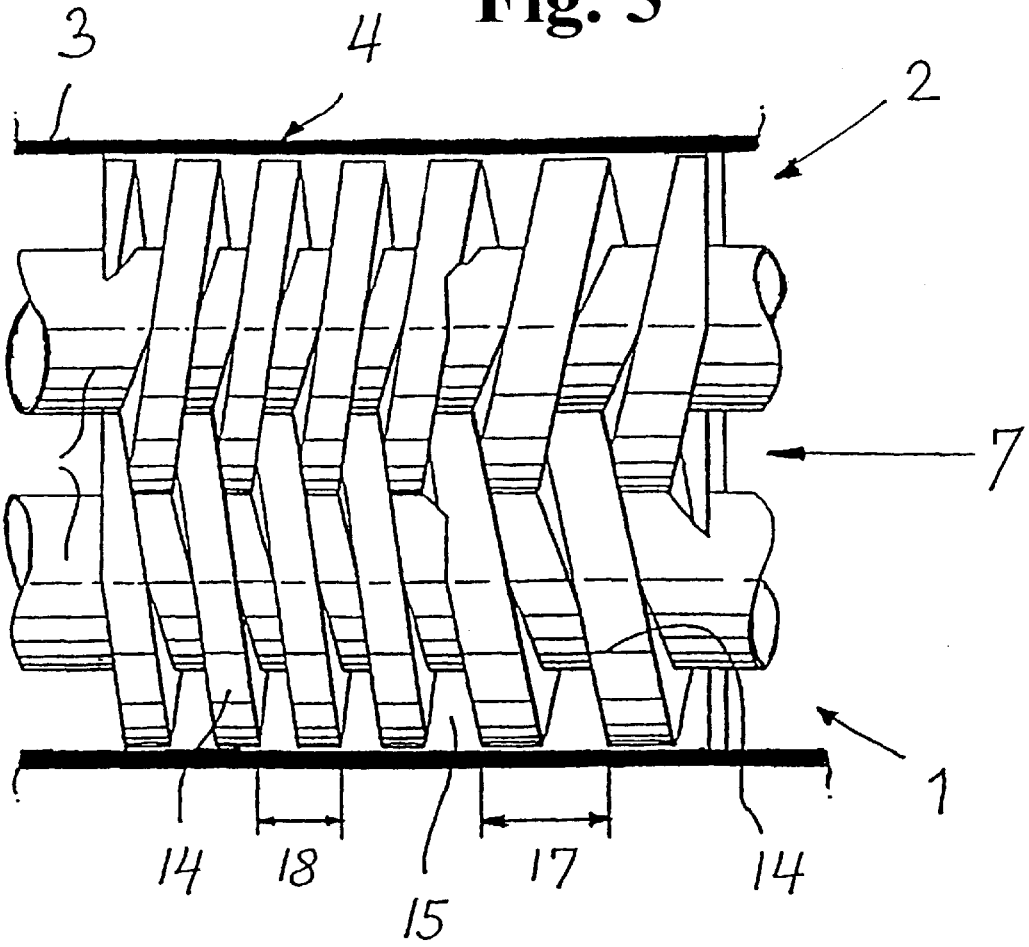
FIG. 5 is an enlarged scale plan view of two screw spindles which mesh with one another.

FIG. 1 shows, in a diagrammatic representation, a turbomachine with two screw spindles 1, 2 whose axes are parallel, which can be driven in opposite directions but with the same rotational speed and which are tightly enclosed on the casing side by a stator 3 which is provided on the outside with thermal insulation 4 (see also FIG. 5).

A compressor 5, which is torsionally connected to each screw spindle 1, 2, is fitted upstream of the respective screw spindle and a working machine 6, which is likewise torsionally connected to each screw spindle 1, 2, is connected downstream of the screw spindle. In the exemplary embodiment represented, the working machine 6 is diagrammatically represented as a turbine. The delivery direction of the fresh air induced by the compressor 5 is designated by an arrow 7.

A pre-combustion chamber 8, which is equipped with a fuel injection nozzle 9 and a sparking plug 10, is located, viewed in the delivery direction 7, before the working machine 6 for the air conveyed by means of the screw spindles 1, 2. The air outlet from the working machine 6 opens into a post-combustion chamber 11, which likewise has a fuel injection nozzle 9 and a sparking plug 10 and is connected by means of an exhaust pipe 12 to the adjacent end of the shaft hollow space 13 of the screw spindles 1, 2, which are respectively configured as hollow shafts.

Figure 3:
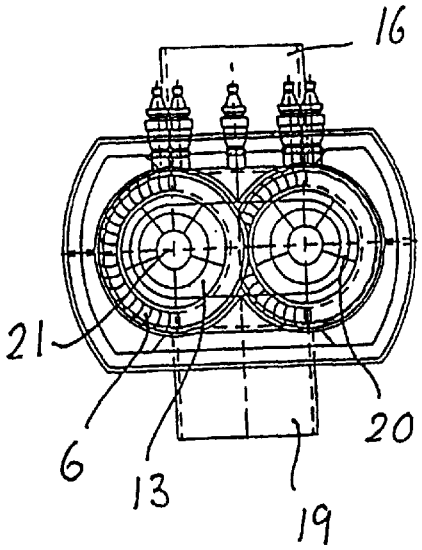
FIG. 3 is a vertical crass section through the left-hand end of FIG. 2.

It may be seen from FIG. 5, that the two screw spindles 1, 2, together with the stator 3 which encloses them tightly, respectively form substantially enclosed air chambers 15 which extend over a threaded section 14 and during rotation of the screw spindles 1, 2, are displaced in the axial delivery direction 7 from an air induction connection 16 (see FIGS. 1 and 3) to an air inlet region (not designated in any more detail) of the working machine 6, which is torsionally connected to the respective screw spindle 1, 2. If the air delivered by the screw spindles 1, 2 is to be compressed on its delivery path additionally to the upstream compressor 5, a pitch decreasing in the delivery direction 7 can be provided for the threaded sections 14. FIG. 5 shows, in the right-hand section of the screw spindle 1, 2, a pitch 17 and a pitch 18, which is reduced relative to the pitch 17, in the left-hand section of FIG. 5.

The shaft hollow space 13 of each screw spindle 1, 2 is configured as a counterflow heat exchanger relative to the air chambers 15, which counterflow heat exchanger opens into an exhaust 19 in the region of the air induction connection 16. In this arrangement, each shaft hollow space 13 can be equipped with exhaust gas guide devices 20 which, in the exemplary embodiment represented, are guide vanes arranged on a common axis 21.

Figure 2:
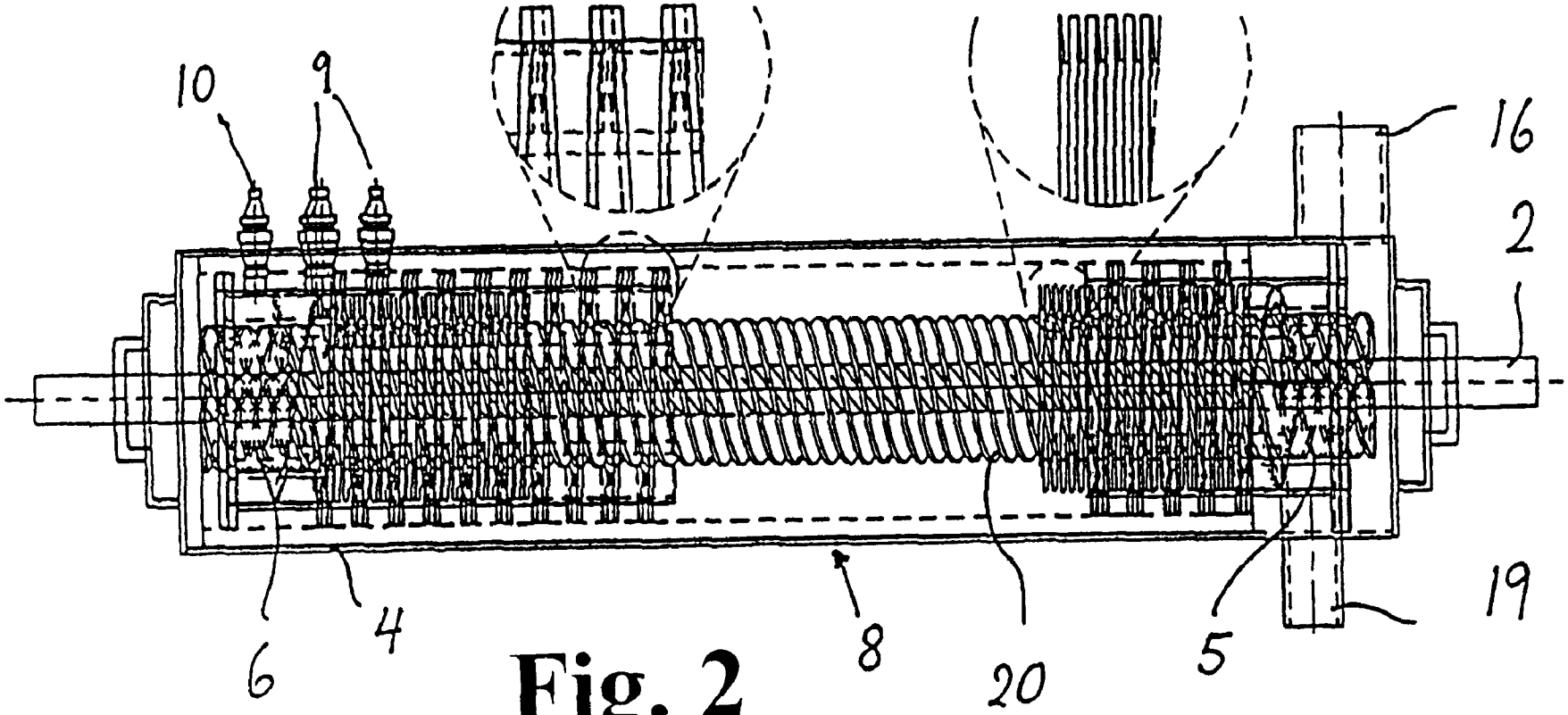
FIG. 2 is a vertical longitudinal section through FIG. 1.
Figure 4:
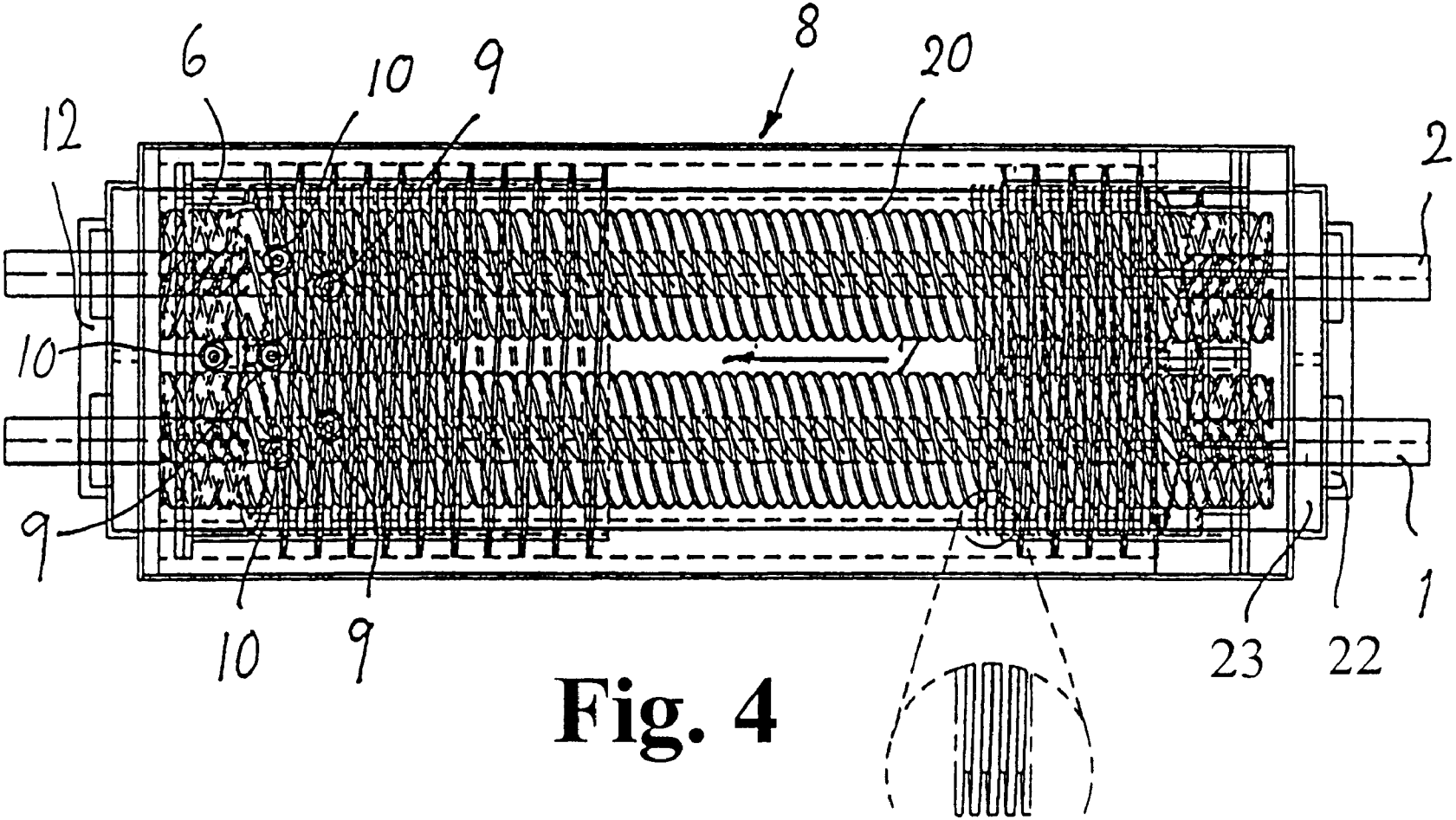
FIG. 4 is a horizontal section through the turbomachine of FIG. 1.

If, by means of a starter (not shown in detail), the two screw spindles 1, 2, which are equipped at one of their ends with the compressor 5 and at their other end with the working machine 6, are put into rotation against one another, the compressors 5 induce fresh air via the air induction connection 16 and, after its compression, this fresh air is then supplied to the right-hand end, in FIGS. 1, 2 and 4, of the screw spindles 1, 2. At this position, the pre-compressed fresh air is fed, in amounts so to speak, sequentially into the air chambers 15, which are moving forward in the axial delivery direction 7 and in which the pre-compressed fresh air is heated isochorically, i.e. at constant chamber volume, on its delivery path to the working machine 6 by the exhaust gases flowing through the counterflow heat exchanger. The exhaust gas heat is therefore converted into an increase in temperature and pressure of the fresh air delivered to the working machine. In the pre-combustion chamber 8, which is provided in the exemplary embodiment, partial combustion of the air then takes place. The air, which has been expanded due to the power output in the working machine 5 but which is still hot, is then heated even further in the post-combustion chamber 11. These heated exhaust gases then flow from the post-combustion chamber 11 via the exhaust pipe 12 through the shaft hollow space 13 of each screw spindle 1, 2 and reject heat to the air enclosed in the air chambers 15 via the inner generated surface of the latter. By this means, this air is heated isochorically in the manner described above. After the temperature of the exhaust gases has been reduced along the counterflow heat exchanger section to approximately the temperature of the induced fresh air, the exhaust gases emerge from the exhaust 19.

Along the counterflow heat exchanger section 120 (see FIGS. 6A & B), the exhaust gas guide devices 20, indicated in the exemplary embodiment as a worm, act to increase the wall surfaces via which the heat has to be rejected to the air chambers 15. In order to achieve good thermal conduction, the exhaust gas guide devices 20 with the, for example, worm-shaped configuration, must be in firm contact by means of their outer generated surface and the generated surface of the shaft hollow space 15. From the manufacturing point of view, the installation can take place in such a way that the complete exhaust gas guide device consists of guide vanes arranged on a common axis 21 and is inserted, after undercooling, concentrically into the shaft hollow space 13 where, during the heating of the air guide device to room temperature, the guide vanes then come into loaded contact, by means of their outer edges, or the generated surface of the shaft hollow space 13.

Bearings 22 and gearwheels 23 for the rotational connection of the two screw spindles 1, 2 are indicated in FIG. 4 for the two screw spindles.

With respect to the course of the method, FIG. 1 shows the induction by means of the designation 16, the compression by means of the designation 5, the external combustion by means of the first sparking plugs 10 in the delivery direction 7, the working cycle symbolized by the working machine 6, the internal combustion by means of the subsequent fuel injection nozzle 9 and sparking plug 10 and the expulsion of the exhaust gases after their temperature reduction in the heat exchanger by means of the designation 19.

Figure 6A:
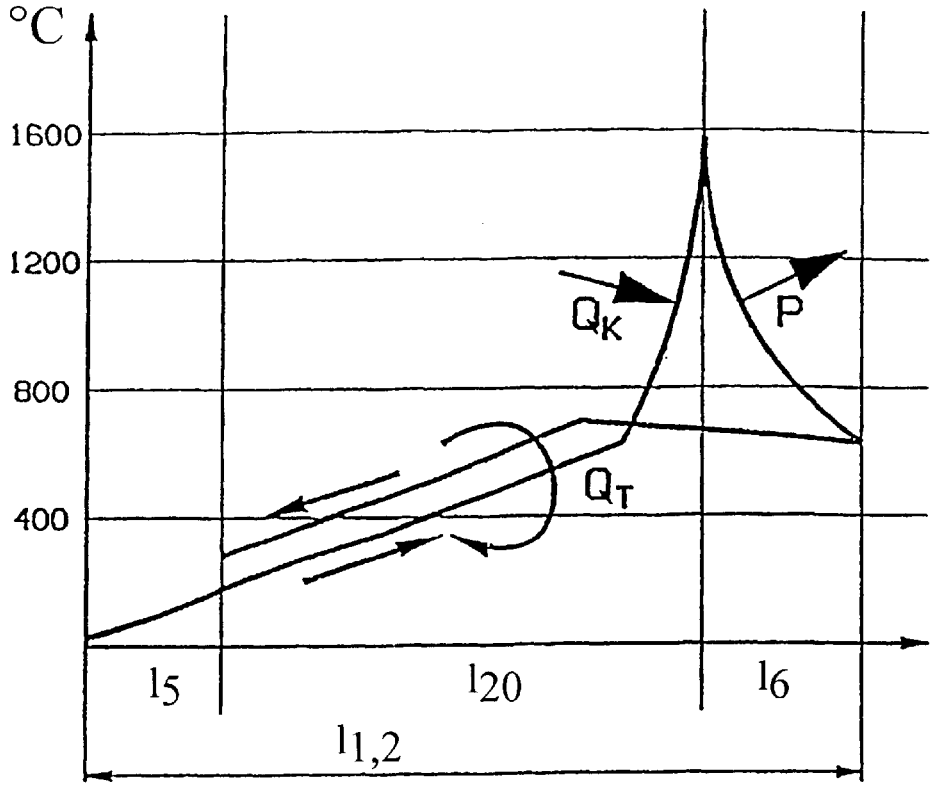
FIG. 6A is a temperature diagram.
Figure 6B:
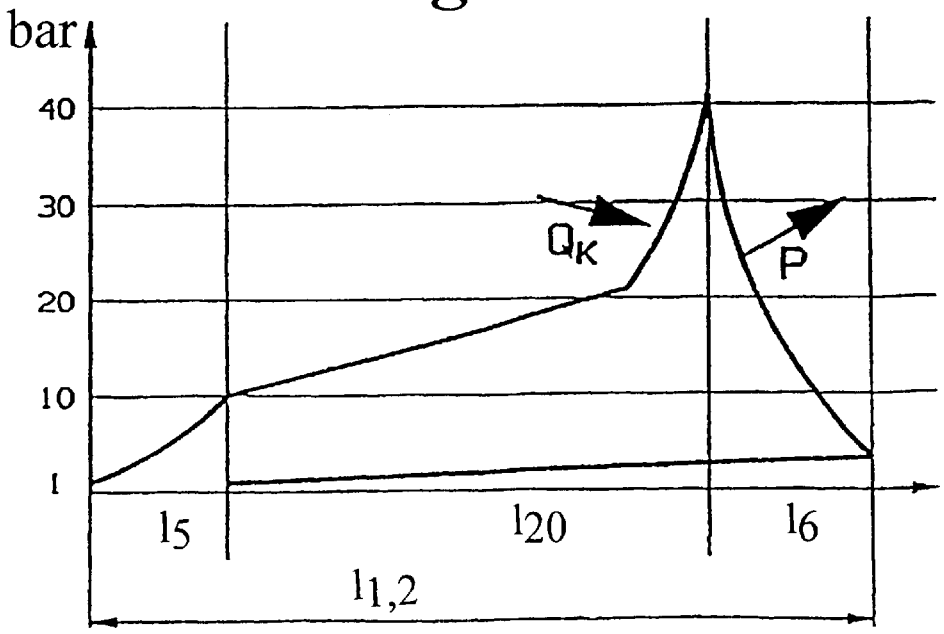
FIG. 6B is a pressure diagram for a method according to the invention.

FIGS. 6A & B show a temperature diagram and pressure diagram for a method according to the invention. In these, temperature and pressure are respectively plotted over the usable length $l_{1,2}$ of the screw spindles. This length $l_{1,2}$ is composed of the partial lengths $l_5$ for the compressor 5, $l_{20}$ for the counterflow heat exchanger and $l_6$ for the working machine. $Q_K$ designates the heat gained from the fuel, $Q_T$ the heat exchange and P the engine power, i.e. the power of the working machine 6.

In operating the turbomachine, fresh air is induced as the working medium, then continuously conveyed in the delivery direction in the delivery direction in individually enclosed delivery and heating chambers, and in the process isochorically heated. The heated air is then introduced into a working machine, in which the excess air pressure generated by the isochoric heating is substantially removed by power output. The heated air is mixed with fuel before its introduction into the working machine and/or the air emerging from the working machine is mixed with fuel and combustion is initiated. The combustion gases are further heated by the combustion being guided in counterflow, i.e. against the delivery direction of the conveying and heating chambers, past the latter in such a way that the induced fresh air is successively and isochorically heated during its continuing conveyance in the conveying direction in the conveying and heating chambers.

Further steps of the method advantageous include one or more of the following: operating the turbomachine in a system which is substantially thermally insulated relative to the surroundings; compressing the induced fresh air before its isochoric heating; reducing the temperature of the combustion gases along the counterflow heat exchanger section to approximately the temperature of the induced fresh air; introducing at least part of the fuel into the isochorically heated fresh air before the working machine and initiating at least partial combustion before the working machine; or introducing water into at least some of the conveying and heating chambers.

The invention in its broader aspects is not limited to the specific steps and mechanisms shown and described but departures may be made therefrom within the scope of the accompanying claims without departing from the principles of the invention and without sacrificing its chief advantages.

What is claimed is:

1. An apparatus having at least two meshed axially parallel screw spindles, means for driving the screw spindles in opposite directions but with the same rotational speed, a thermal insulated stator tightly enclosing the screw spindles on the casing side and forming substantially enclosed respective air chambers extending over a threaded section, the chambers being displaced during rotation of the screw spindles in the axial delivery direction from an air induction connection to an air inlet region of a working machine torsionally connected to the screw spindles, a combustion chamber associated with the working machine and which has a fuel supply and ignition device, means for respectively introducing the exhaust gases via an exhaust pipe into an end of a shaft hollow space opposite to the air induction connection, the shaft hollow space being configured relative to the air chambers as a counterflow heat exchanger and opening into an exhaust in the region of the air induction connection.

2. The appliance as claimed in claim 1, characterized in that the working machine is a turbine.

3. The appliance as claimed in claim 1, characterized in that a compressor, which operates with the working machine on the same shaft, is connected upstream of each screw spindle.

4. The appliance as claimed in claim 1, characterized in that each screw spindle has at least one axial section with a thread pitch which decreases in the delivery direction.

5. The appliance as claimed in claim 1, characterized in that each shaft hollow space is equipped with exhaust gas guide devices.

6. The appliance as claimed in claim 5, characterized in that the exhaust gas guide devices have a worm-shaped configuration and their outer generated surface is in firm contact with the generated surface of the shaft hollow space.

7. The appliance as claimed in claim 1, including a preburner which has a fuel supply device and an ignition device, the preburner being arranged before the working machine for the air conveyed by means of the screw spindles.

8. The appliance as claimed in claim 1, characterized in that the counterflow heat exchanger has an exhaust gas conduit, which opens into the exhaust, between the thermal insulation and the outer wall of the stator.

* * * * *